US009915484B2

(12) United States Patent
Sallais et al.

(10) Patent No.: US 9,915,484 B2
(45) Date of Patent: Mar. 13, 2018

(54) METHOD FOR PRODUCING A MULTILAYER ELEMENT HAVING A PROTECTIVE COATING

(71) Applicants: L'AIR LIQUIDE, SOCIETE ANONYME POUR L'ETUDE ET L'EXPLOITATION DES PROCEDES GEORGES CLAUDE, Paris (FR); CENTRE NATIONAL DE LA RECHERCHE SCIENTIFIQUE, Paris (FR); UNIVERSITE DE LORRAINE, Nancy (FR)

(72) Inventors: Damien Sallais, Versailles (FR); Laurent Prost, Gif sur Yvette (FR); Pascal Del-Gallo, Dourdan (FR); Marc Wagner, Saint Maur des Fosses (FR); Michel Vilasi, Bouxieres aux Dames (FR); Thierry Mazet, Nancy (FR); Stephane Mathieu, Villers les Nancy (FR)

(73) Assignees: L'AIR LIQUIDE SOCIÉTÉ ANONYME POUR L'ÉTUDE ET L'EXPLOITATION DES PROCEDES GEORGES CLAUDE, Paris (FR); CENTRE NATIONAL DE LA RECHERCHE SCIENTIFIQUE, Paris (FR); UNIVERSITE DE LORRAINE, Paris (FR)

( * ) Notice: Subject to any disclaimer, the term of this patent is extended or adjusted under 35 U.S.C. 154(b) by 123 days.

(21) Appl. No.: 14/785,451

(22) PCT Filed: Mar. 17, 2014

(86) PCT No.: PCT/FR2014/050615
§ 371 (c)(1),
(2) Date: Oct. 19, 2015

(87) PCT Pub. No.: WO2014/170570
PCT Pub. Date: Oct. 23, 2014

(65) Prior Publication Data

US 2016/0061539 A1 Mar. 3, 2016

(30) Foreign Application Priority Data

Apr. 19, 2013 (FR) ..... 13 53614

(51) Int. Cl.
*F28F 13/18* (2006.01)
*F28F 3/08* (2006.01)
(Continued)

(52) U.S. Cl.
CPC ..... *F28F 13/18* (2013.01); *C22F 1/10* (2013.01); *C23C 10/48* (2013.01); *C23C 10/60* (2013.01);
(Continued)

(58) Field of Classification Search
CPC .... F28F 13/18; F28F 19/06; F28F 3/08; F28F 21/089; F28F 2275/061; F28F 2260/02;
(Continued)

(56) References Cited

U.S. PATENT DOCUMENTS 7,186,388 B2 3/2007 Bowe et al.
2003/0022008 A1 1/2003 Jogan et al.
(Continued)

FOREIGN PATENT DOCUMENTS

DE 37 09 278 9/1988
DE 198 34 238 2/2000

OTHER PUBLICATIONS

International Written Opinion for PCT/FR2014/050615, dated May 13, 2014.
(Continued)

*Primary Examiner* — Moshe Wilensky
(74) *Attorney, Agent, or Firm* — Christopher J. Cronin

(57) ABSTRACT

Process for producing an element comprising a multilayer architecture, the layers of which comprise primary channels on their upper faces, said process comprising the following successive steps:

(Continued)

(a) producing secondary channels on the lower faces of each layer, each secondary channel being intended to be facing a primary channel of the neighboring lower layer within the architecture,
(b) depositing a coating that protects against oxidation at a temperature of between 500° C. and 1000° C. and against corrosion over all of the lower and upper surfaces of the layers,
(c) sanding or mechanical cleaning of the surfaces intended to be assembled, and
(d) assembling via superposition of the various layers so that each secondary channel of a lower face of an upper layer is facing and is centered on a primary channel of the neighboring lower layer, the width of each secondary channel being greater than the width of the primary channel which it is facing within the architecture.

5 Claims, 2 Drawing Sheets

(51) Int. Cl.

| | |
|---|---|
| ***F28F 19/06*** | (2006.01) |
| ***F28F 21/08*** | (2006.01) |
| ***F28D 9/00*** | (2006.01) |
| ***C23C 10/48*** | (2006.01) |
| ***C23C 10/60*** | (2006.01) |
| ***C22F 1/10*** | (2006.01) |
| ***C23C 18/08*** | (2006.01) |

(52) U.S. Cl.
CPC ..... *C23C 18/08* (2013.01); *F28D 9/0037* (2013.01); *F28F 3/08* (2013.01); *F28F 19/06* (2013.01); *F28F 21/089* (2013.01); *F28F 2260/02* (2013.01); *F28F 2275/061* (2013.01)

(58) Field of Classification Search
CPC ..... F28D 9/0037; C22F 1/10; C23C 18/08; C23C 10/60; C23C 10/48
See application file for complete search history.

(56) References Cited

U.S. PATENT DOCUMENTS

| | | |
|---|---|---|
| 2007/0210037 A1 | 9/2007 | Ishida et al. |
| 2010/0051248 A1 | 3/2010 | Inatomi et al. |

OTHER PUBLICATIONS

International Search Report for PCT/FR2014/050615, dated May 13, 2014.
French Search Report and Written Opinion for FR 1353614, dated Jan. 8, 2014.

METHOD FOR PRODUCING A MULTILAYER ELEMENT HAVING A PROTECTIVE COATING

CROSS-REFERENCE TO RELATED APPLICATIONS

This application is a § 371 of International PCT Application PCT/FR2014/050615, filed Mar. 17, 2014, which claims § 119(a) foreign priority to French patent application FR1353614, filed Apr. 19, 2013.

BACKGROUND

Field of the Invention

The present invention relates to the production of a corrosion-protection coating on a multilayer element having channels.

Related Art

In order to increase the thermochemical resistance of metal alloy parts subjected to chemically harsh conditions induced by gas mixtures, one solution consists in depositing a protective coating on the exposed surfaces in order to produce, in the best case scenario, a barrier, or at the very least an impediment to the corrosion phenomenon.

In the case of parts having a complex architecture after assembly, with channels of small dimensions and of various geometries that may have a high tortuosity and zones that are difficult to access, the conventional techniques for application of these protective coatings do not make it possible to produce a uniform and homogeneous deposition over the whole of the architecture.

Alternative solutions must consequently be implemented, such as the production of the protective coating before assembling the elements constituting the complex part. In this case, the protective coating must however be deposited selectively on the surfaces intended to be protected, without modifying the surface finish of the surfaces intended to be assembled, in order not to disrupt the subsequent assembling step.

The solutions that currently exist that make it possible to apply a selective deposition consist in producing a masking or resist of the surfaces that do not have to be coated during the coating deposition step. Since the deposition of the protective coating takes place at high temperature (i.e. between 600° C. and 1100° C.), these maskings must be resistant to these high temperatures.

Among these solutions are mechanical masking or masking with the aid of a paint or a varnish.

Regarding mechanical masking, the drawbacks of this technique lie, on the one hand, in the production of the equipment, which is difficult and expensive in the case of small-sized complex surfaces to be mechanically masked and, on the other hand, in the risk of a local absence of coating (linked to an inaccuracy in the positioning of the masking equipment or to the geometry of the equipment itself) or of a local excess of coating (prejudicial for the assembly).

Regarding masking with the aid of a high-temperature paint or varnish, the major difficulty of this technique remains its tricky selective application to small-sized complex surfaces, any inaccuracy in its application possibly leading to a local lack of coating (preferred site of corrosion) or to a local excess of coating (prejudicial to the assembly step).

Starting from here, one problem that is faced is to provide an improved process for coating channels incorporated within a multilayer architecture.

SUMMARY OF THE INVENTION

One solution of the present invention is a process for producing an element comprising a multilayer architecture, the layers of which comprise primary channels on their upper faces, said process comprising the following successive steps:

(a) producing secondary channels 2 on the lower faces of each layer, each secondary channel 2 being intended to be facing a primary channel 1 of the neighboring lower layer within the architecture, (b) depositing a coating that protects against oxidation at a temperature of between 500° C. and 1000° C. and against corrosion over all of the lower and upper surfaces of the layers, (c) sanding or mechanical cleaning of the surfaces intended to be assembled, and (d) assembling via superposition of the various layers so that each secondary channel 2 of a lower face of an upper layer is facing and is centered on a primary channel 1 of the neighboring lower layer, the width of each secondary channel 2 being greater than the width of the primary channel 1 which it is facing within the architecture.

DETAILED DESCRIPTION OF THE INVENTION

Figure 1:
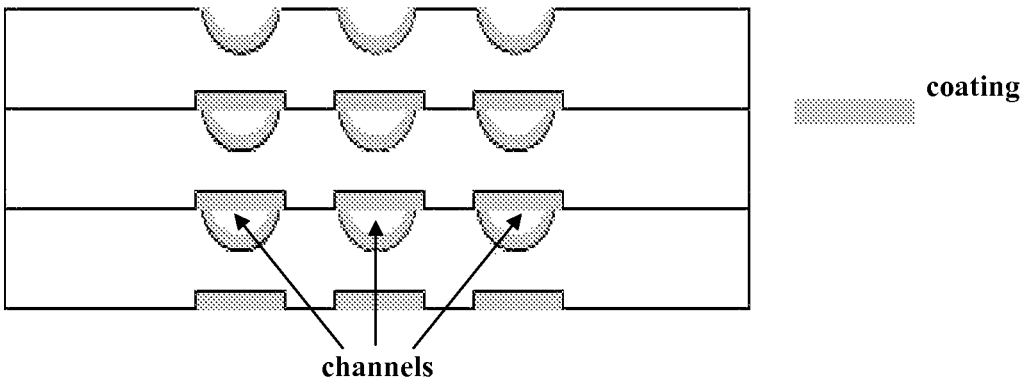
FIG. 1 is a cross-sectional schematic view of the inventive multilayer architecture.

The expression "centered on" is understood to mean centering with a margin of error of less than 0.15 mm.

The expression "secondary channels" is understood to mean additional channels located on the opposite face of the layers having primary channels at the surface.

The process according to the invention makes it possible to avoid the production of masking in zones having a complex architecture, i.e. in the channels, which is difficult to carry out and which may generate a contamination of the coating or of the surfaces to be assembled.

It should be noted that the secondary channels have the objective, after deposition of the coating and assembly of the various layers, of providing a complete and homogeneous protection of the whole of the surface of the channels, without local lack of coating that may generate a preferred site of corrosion.

The channels will preferably have a semicircular cross section and the counter-channels will preferably have a cross section of half-rectangle shape, when considering a rectangle cut lengthwise.

Within the context of the invention, the coating may be formed by pack cementation by carrying out a low-activity aluminization starting from a mixture of a metal ($Ni_2Al_3$) powder, a diluent ($Al_2O_3$) powder and also a powder of an activating agent (such as $NH_4F$, $NH_4Cl$, $CrCl_3$).

In this case, the process may comprise, downstream of the assembly step:

(i) a step of heating, under vacuum or under Ar, the element buried in the mixture of powders at a temperature of between 950° C. and 1000° C. for a duration of between 8 and 10 h. This process makes it possible to directly form the desired NiAl coating.

Another possibility is to choose to form a coating by pack cementation by carrying out a high-activity aluminization starting from a mixture comprising an Al metal powder, a diluent ($Al_2O_3$) powder and a powder of an activating agent (such as $NH_4F$, $NH_4Cl$, $CrCl_3$).

In this case, said process comprises, downstream of the assembly step:

(i) a first step of heating the element buried in the mixture of powders at a temperature of 600° C. for a duration of between 8 and 10 h so as to form a first layer of $NiAl_3$; and (ii) a second step of annealing the element resulting from step (i) at a temperature of between 1000° C. and 1100° C. for a duration of between 4 and 8 h so as to convert this layer of (brittle) $NiAl_3$ into NiAl (desired coating).

The step of producing the secondary channels may comprise mechanical machining or chemical milling.

The assembly step may be carried out in the following manner: by diffusion welding, a technique that consists, in principle, in obtaining from two separate elements a single homogeneous block by diffusion of material in the solid state by applying a constant pressure during a heating cycle in a vacuum furnace (press furnace).

It should be noted that the element in question here is preferably an element made of metal alloy and the coating is preferably an anti-corrosion coating.

Figure 2:
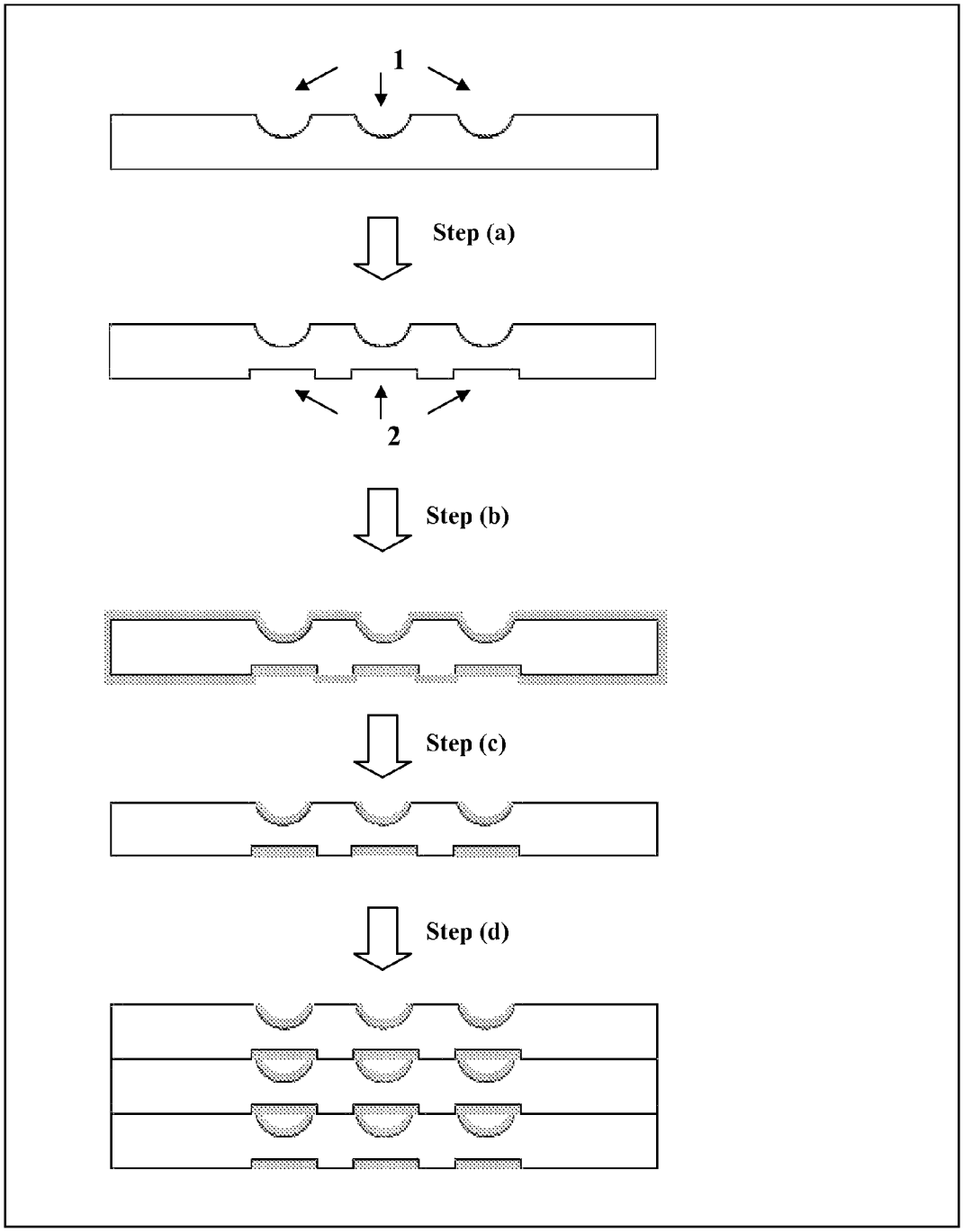
FIG. 2 is a flow chart showing the main steps of an embodiment of the inventive process.

FIG. 2 schematically shows the main steps of the process according to the invention:

Step (a): production of secondary channels on the lower faces of each layer, each secondary channel being intended to be facing a primary channel of the neighboring lower layer within the architecture. These secondary channels will have to be centered on the primary channels of the opposite face and have a width greater than the width of the primary channels in order to ensure a protection of the whole of the surface of the channel after assembly, including in the case of a slight error in positioning the parts on one another during the assembly.

Step (b): deposition of a protective coating on all of the lower and upper surfaces of the layers. In the present case, masking is completely sidestepped.

Step (c): mechanical grinding of the surfaces intended to be assembled. By virtue of this technique (to be explained), only the surfaces of the primary and secondary channels retain the coating, the other surfaces being bared in order to be more easily assembled.

Step (d): assembling via superposition of the various layers so that each secondary channel of a lower face of an upper layer is facing and is centered on a primary channel of the neighboring lower layer. This results, after assembly, in an assembled part having channels that are coated homogeneously over the whole of their surface.

Another subject of the present invention is a metallic heat exchanger comprising a multilayer architecture, each layer comprising primary channels on its upper face, characterized in that:

- each lower face of the layers comprises secondary channels centered on the channels of the neighboring lower layer within the architecture and having a width greater than the width of the primary channels, and
- a coating that protects against oxidation at a temperature of between 500° C. and 1000° C. and against corrosion, and the thickness variation of which is less than 10 μm over all of the surfaces of the primary and secondary channels.

Preferably, the heat exchanger may have one or more of the following features:

- the thickness of the coating is between 50 and 100 μm,
- the channels are millimeter-sized channels,
- the layers of the architecture have a thickness of between 1.6 and 2 mm.

Preferably, the heat exchanger according to the invention will be used for the production of hydrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and the include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A process for producing a heat exchanger comprising a multilayer architecture, the layers of which comprise primary channels on upper faces thereof, said process comprising the following successive steps:

- for each layer, producing secondary channels on a lower face of thereof, each secondary channel of a layer being intended to be facing a primary channel of an adjacently lower layer within the architecture;
- depositing a coating over all of the lower and upper surfaces of the layers, the coating protecting against oxidation at temperatures between 500° C. and 1000° C. and also protecting against corrosion;

for each layer, sanding or mechanically cleaning portions of the faces that that, during assembly of the multilayer architecture, are intended to be diffusion welded to sanded or mechanically cleaned portions of adjacent layers;

superposing each of the sanded or mechanically cleaned layers so that each secondary channel is facing and is centered on a primary channel of an adjacently lower layer within the architecture; and diffusion welding the superposed layers, wherein a width of each secondary channel is greater than a width of the primary channel which it is facing within the architecture.

2. The process of claim 1, wherein the coating is formed from a mixture comprising an activating agent powder, an $Ni_2Al_3$ metal powder and a solvent $Al_2O_3$.

3. The process of claim 2, wherein the process further comprises, after said diffusion welding:

burying the heat exchanger in the mixture of powders; and heating the heat exchanger under vacuum or under Ar at a temperature between 950° and 1000° C. for a duration of between 8 and 10 hours.

4. The process of claim 1, wherein the coating is formed from a mixture comprising an activating agent powder, an Al metal powder and a solvent $Al_2O_3$.

5. The process of claim 4, wherein the process further comprises, after said diffusion welding step:

burying the heat exchanger in the mixture of powders; and heating the buried heat exchanger at a temperature of about 600° C. for a duration of between 8 and 10 hours so as to forma first layer of $NiAl_3$; and after said heating step, annealing the heat exchanger at a temperature of between 1000° C. and 1100° C. for a duration of between 4 and 8 hours so as to convert the $NiAl_3$ layer into a NiAl layer.

* * * * *